US007757504B2

(12) United States Patent
Yonezawa et al.

(10) Patent No.: US 7,757,504 B2
(45) Date of Patent: Jul. 20, 2010

(54) AIR CONDITIONING CONTROLLER

(75) Inventors: Kenzo Yonezawa, Tokyo (JP); Yasuo Takagi, Kanagawa (JP); Yutaka Iino, Kanagawa (JP); Nobutaka Nishimura, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 517 days.

(21) Appl. No.: 11/783,936

(22) Filed: Apr. 13, 2007

(65) Prior Publication Data

US 2007/0240437 A1 Oct. 18, 2007

(30) Foreign Application Priority Data

Apr. 14, 2006 (JP) ..... P2006-112522

(51) Int. Cl.
*F25B 49/00* (2006.01)
*F25D 17/04* (2006.01)
*G05D 22/02* (2006.01)

(52) U.S. Cl. ..... 62/176.6; 236/44 C

(58) Field of Classification Search ..... 62/176.6, 62/176.1; 236/44 C, 44 A
See application file for complete search history.

(56) References Cited

U.S. PATENT DOCUMENTS 4,873,649 A 10/1989 Grald et al.
5,170,935 A 12/1992 Federspiel et al.
2006/0026976 A1* 2/2006 Carpenter ..... 62/176.1
2006/0184283 A1 8/2006 Lee et al.

FOREIGN PATENT DOCUMENTS

CN 1715789 A 1/2006

(Continued)

OTHER PUBLICATIONS

Notification of Reasons for Refusal issued by the Chinese Patent Office on Oct. 10, 2008, for Chinese Patent Application No. 200710097031.3, and English-language translation thereof.

(Continued)

*Primary Examiner*—Marc E Norman
(74) *Attorney, Agent, or Firm*—Finnegan, Henderson, Farabow, Garrett & Dunner L.L.P.

(57) ABSTRACT

An air conditioning controller is provided with a room temperature-humidity combination calculation unit, a temperature-humidity setting value determination unit and a temperature-humidity control unit. The room temperature-humidity combination calculation unit is configured to calculate combinations of room temperature and room humidity corresponding to a target value of a thermal comfort index PMV. The temperature-humidity setting value determination unit is configured to select and determine a combination of the room temperature and humidity that achieves energy saving among the calculated combinations of the room temperature and humidity. The temperature-humidity control unit is configured to separately control the room temperature and humidity so that the room temperature and humidity would measure up respectively to the determined temperature and humidity values.

3 Claims, 5 Drawing Sheets

FOREIGN PATENT DOCUMENTS

| | | |
|---|---|---|
| JP | 5-126380 | 5/1993 |
| JP | 10-141736 | 5/1998 |
| JP | 10-292941 | 11/1998 |
| JP | 3049266 | 3/2000 |
| JP | 2002-286274 | 10/2002 |
| JP | 2004-60978 | 2/2004 |
| TW | 265404 | 12/1995 |
| TW | 463026 | 11/2001 |
| TW | 265572 | 5/2005 |

OTHER PUBLICATIONS

Notification of the 2nd Office Action issued by the Chinese Patent Office on Mar. 20, 2009, for Chinese Patent Application No. 200710097031.3, and English-language translation thereof.

Notification of Reasons for Refusal in foreign counterpart application 10-2007-0035560 issued by the Korean Patent Office on Feb. 27, 2008.

Fumio Yamada et al., "Comfort Air-conditioning Control for Building Energy Saving," Toshiba review, vol. 59, No. 4, pp. 40-43 (2004).

* cited by examiner

AIR CONDITIONING CONTROLLER

CROSS-REFERENCE TO RELATED APPLICATION

This application is based upon and claims the benefit of priority from the prior Japanese Application No. 2006-112522, filed on Apr. 14, 2006; the entire contents of which are incorporated herein by reference.

BACKGROUND OF THE INVENTION

1. Field of the Invention

The present invention relates to an air conditioning controller achieving an air conditioning control that is finely seasonable and largely effective in energy saving without decreasing comfort in living space.

2. Description of the Related Art

Nowadays, it is said that energy consumption related to air conditioning accounts for approximately half of energy consumption in entire building equipment. For this reason, advancement in energy saving in air conditioning control largely contributes to energy saving in entire building equipment. An office building serving as an amenity space is required to satisfy thermal sensation, that is, so-called comfort of occupants in rooms. In some cases, energy saving and comfort may have conflicting aspects. However, it is possible to avoid a waste of energy by saving excessive energy consumption within a range to maintain comfort of occupants.

As one example of such air conditioning control, air conditioning using a thermal comfort index PMV (predicted mean vote) has been known.

A comfortable air-conditioning control achieving a good balance between energy saving and comfort of occupants by using a thermal comfort index PMV has been already put into practical use, as described in Japanese Patent Application Laid-open Publication No. Hei 5-126380, for example. Moreover, an algorithm and the like for controlling temperature and humidity in air conditioning while saving energy as much as possible have been invented as described in Japanese Patent Application Laid-open Publication No. Hei 10-292941. As for a non-patent document, such an air conditioning control has also been proposed in "Comfort Air-conditioning Control for Building Energy Saving" *Toshiba review, Vol.* 59 No. 4, pp. 40-43 (2004).

SUMMARY OF THE INVENTION

The apparatus described in Japanese Patent Application Laid-open Publication No. Hei 5-126380 employs a method for automatically computing a temperature setting value that makes a thermal comfort index PMV constant. This case does not cover a humidity control, since a usual air conditioner needs to temporarily supercool the air for decreasing humidity, and then to heat the air for keeping temperature constant. For example, when humidity is controlled in air cooling in summer time, the air to be supplied needs to be reheated.

For the foregoing reason, a conventional dehumidification control has a problem that energy is excessively consumed as compared to a case of a technique for controlling only temperature.

The present invention has been made in order to solve the foregoing problem. An object of the present invention is to provide an air conditioning controller that provides both comfort of occupants and energy saving at the same time by controlling both room temperature and room humidity.

In order to achieve the foregoing object, an aspect of the present invention is summarized as an air conditioning controller using thermal sensation of a human as a thermal comfort index, and including a room temperature-humidity combination calculation unit, a temperature-humidity setting value determination unit, and a temperature-humidity control unit. The room temperature-humidity combination calculation unit is configured to calculate combinations of room temperature and room humidity corresponding to a target value of the thermal comfort index. The temperature-humidity setting value determination unit is configured to select a combination of the room temperature and humidity that achieves energy saving in every fixed cycle among the combinations of the room temperature and humidity calculated by the room temperature-humidity combination calculation unit, and then to determine a temperature setting value and a humidity setting value. The temperature-humidity control unit is configured to separately control the room temperature and the room humidity so that the room temperature and humidity would measure up respectively to the temperature setting value and the humidity setting value determined by the temperature-humidity setting value determination unit.

According to the aspect of the present invention, it is possible to control both of room temperature and room humidity, and thereby to achieve an air conditioning control that is finely seasonable and largely effective in energy saving without decreasing the comfort of occupants.

DETAILED DESCRIPTION OF THE EMBODIMENTS

About Thermal Comfort Index PMV

Figure 1:
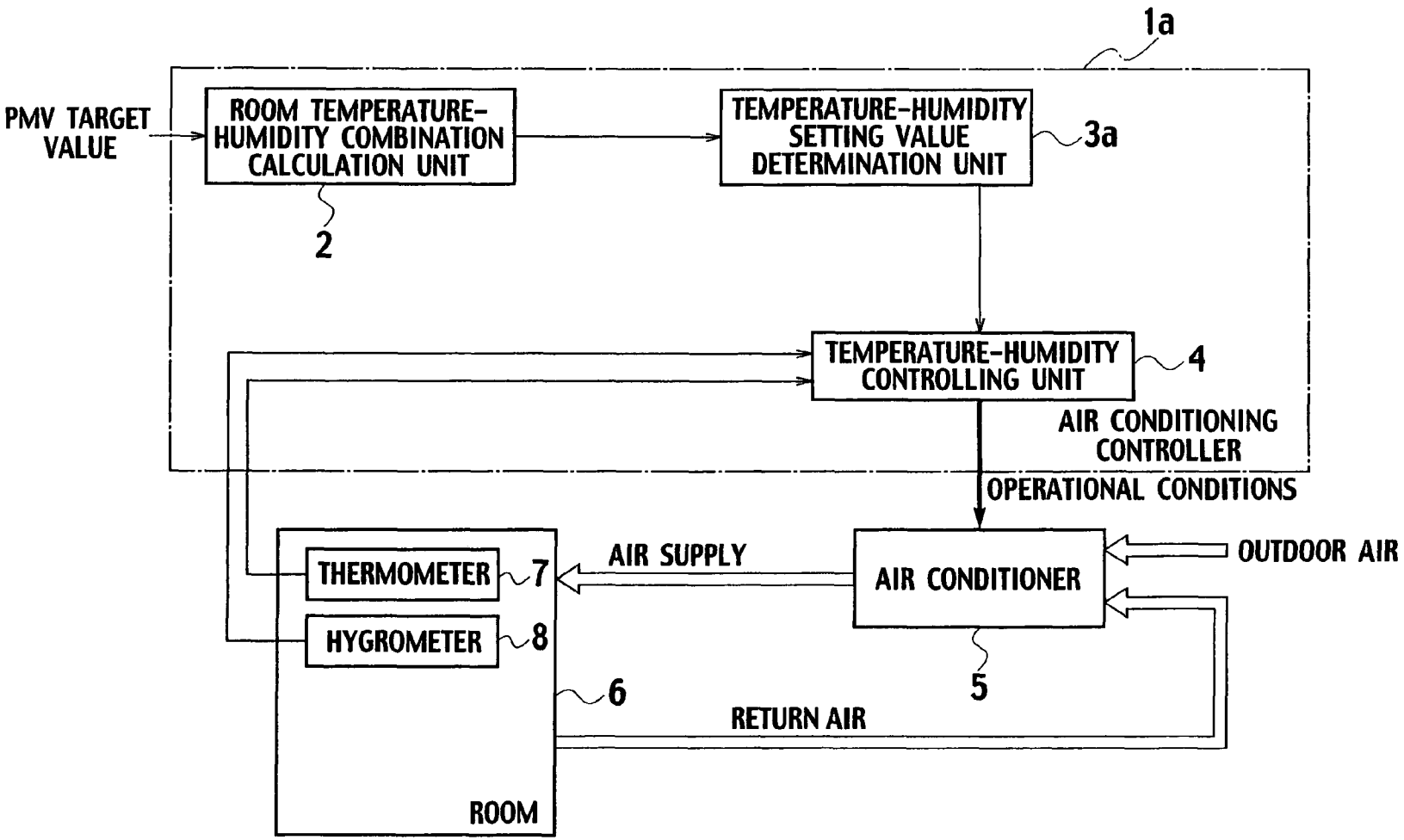
FIG. 1 is a block diagram showing an air conditioning controller according to a first embodiment of the present invention.

To begin with, a brief description will be provided below for a thermal comfort index PMV used in the explanation of embodiments of the present invention.

It is important to consider thermal sensation of humans for hotness and coldness for the purpose of ensuring an appropriate room temperature environment while taking comfort of humans into account. The following are variables that influence the thermal sensation of a human: (1) an air temperature; (2) a relative humidity; (3) a mean radiation temperature; (4) an airflow velocity; (5) an amount of activity (a calorific value in a human body); and (6) an amount of clothing.

The calorific value of a human is a sum of an amount of radiation by convection, an amount of heat release by radiation, an amount of evaporation heat from the human, and an amount of heat release and an amount of heat accumulation by breathing. When systems of the above variables are in thermal equilibrium, the human body is in a thermally neutral state, and this is a comfort state such that the human neither feels hot nor cold. In contrast, the systems of the above variables are not in thermal equilibrium, the human feels hot or cold. Prof. Fanger, Technical University of Denmark, introduced the derivation of the comfort equation in 1967, and then, as taking the introduction as a starting point, associated a heat load on a human body with the hot and cold sensation of a human by statistically analyzing the questionnaires of a large number of Western test subjects. Consequently, Prof. Fanger proposed Predicted Mean Vote (PMV). This PMV has been employed in the ISO standard in recent years, and thus recently has become used frequently. The PMV that is an index of hot and cold sensation is expressed as a value in the following 7-point scale.

+3: hot
+2: warm
+1: slightly warm
0: neutral, comfort
−1: slightly cool
−2: cool
−3: cold Herein, a comfort range for a human is −0.5 to +0.5.

Among the above six variables, the amount of activity indicating activity intensity is usually expressed as a degree of metabolism, met, and the amount of clothing is usually expressed by using a unit, clo.

met: a unit indicating the degree of metabolism, and resting metabolism in thermally comfort conditions is used for a reference.

$$1(\text{met})=58.2\ (\text{W/m}^2)=50\ (\text{kcal/m}^2\cdot\text{h})$$

clo: a unit indicating a thermal isolation of clothing. 1 clo is a value indicating a closing state where the amount of heat release from a body surface and 1 met metabolism reach an equilibrium under room conditions below the temperature 21° C., the relative humidity 50% and the airflow velocity 5 cm/s, inclusive. 1 clo is expressed as follows, if it is converted into a usual thermal resistance value.

$$1(\text{clo})=0.155\ (\text{m}^2\cdot{}^\circ\text{C./W})=0.18\ (\text{m}^2\cdot\text{h}\cdot{}^\circ\text{C./kcal})$$

Reduction in an air conditioning load and thereby energy saving can be achieved in a way that a PMV target value is set to be greater in air cooling, and to be smaller in air heating within the comfort range (−0.5<PMV<+0.5).

A relationship between PMV, which is an index of thermal sensation, and a heat load on a human body calculated by using Fanger's comfort equation was statistically analyzed on the basis of data obtained from a large number of test subjects. As a result, the relationship is expressed as the predicted mean vote (PMV) in the following function of the heat load on a human body L and the degree of metabolism M.

$$\text{PMV}=(0.352\cdot\exp(-0.042\cdot M/A)+0.032)\cdot L, \qquad \text{[Formula 1]}$$

where M denotes the degree of metabolism (kcal/m$^2$·h), A denotes an area of a human body surface (m$^2$), and L denotes the heat load on a human body (kcal/m$^2$·h).

First Embodiment

Hereinafter, a description will be provided for an air conditioning controller according to a first embodiment of the present invention by referring to the accompanying drawings. In the following description for the embodiment, PMV is used as a thermal comfort index. Moreover, an air conditioner to be controlled in the embodiment is a system that is capable of separately controlling room temperature and room humidity while saving energy consumption.

FIG. 1 is a block diagram showing an air conditioning controller according to the first embodiment of the present invention.

An air conditioning controller 1*a* shown in FIG. 1 includes a room temperature-humidity combination calculation unit 2, a temperature-humidity setting value determination unit 3*a* and a temperature-humidity control unit 4. The room temperature-humidity combination calculation unit 2 calculates combinations of room temperature and room humidity corresponding to each PMV target value. In every fixed cycle, the temperature-humidity setting value determination unit 3*a* selects and determines one of the combinations of the room temperature and humidity calculated by the room temperature-humidity combination calculation unit 2. Moreover, the temperature-humidity control unit 4 separately controls the room temperature and the room humidity so that the room temperature and humidity would measure up respectively to the temperature value and the humidity value determined by the temperature-humidity setting value determination unit 3*a*. The air conditioning controller 1*a* controls an air conditioner 5, and thereby adjusts the temperature and the humidity in a room 6. In FIG. 1, reference numerals 7 and 8 denote a thermometer and a hygrometer in the room 6, respectively.

Figure 2:
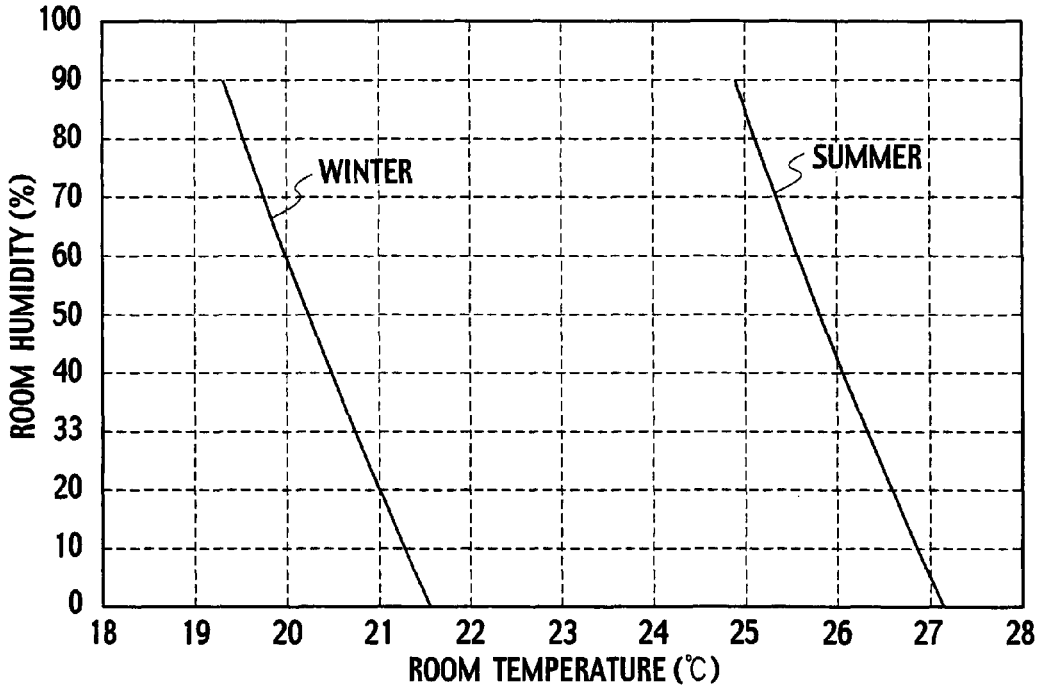
FIG. 2 is an explanatory diagram showing examples of a combination of room temperature and room humidity that satisfies a target PMV value.

The room temperature-humidity combination calculation unit 2 figures out a combination of the room temperature and humidity satisfying one of PMV target values, which are each determined for each season, for example. FIG. 2 shows an example of the combinations of the room temperature and humidity corresponding to the PMV values. In FIG. 2, a horizontal axis denotes the room temperature (° C.), and a vertical axis denotes the room humidity (%). In the example of FIG. 2, a control target is an office building. Moreover, 0.3 is employed as the PMV target value in summer season when air cooling is used, and this value is close to the highest comfort range 0.5. On the other hand, −0.3 is employed as the PMV target value in winter season when air heating is used, and this value is close to the lowest comfort range −0.5.

Calculation conditions based on the assumption of an office building are: the amount of activity, 1.2 met; the wind velocity (airflow velocity v), 0.1 m/s; the amount of clothing in summer, 0.5 clo; and the amount of clothing in winter, 1.0 clo. In addition, here, assume that the PMV value is not changed by the wind velocity v under the condition that the wind velocity v≦0.1 m/s.

Among an infinite number of foregoing combinations of the room temperature and humidity, the temperature-humidity setting value determination unit 3*a* determines the values of the room temperature and humidity achieving energy saving in every fixed cycle. For example, the temperature-humidity setting value determination unit 3*a* selects the values of the room temperature and humidity minimizing the difference between an outdoor air enthalpy and a room air enthalpy. The outdoor air enthalpy is calculated by using a known relational expression from measured values of outdoor air temperature and outdoor air humidity, while the room air enthalpy is calculated by using the known relational expression from measured values of the room temperature and room humidity.

The temperature-humidity control unit 4 is composed of a direct digital controller (DDC) or the like. The temperature-humidity control unit 4 separately controls the room temperature and humidity so that the room temperature and humidity would measure up respectively to the temperature setting value and the humidity setting value outputted from the temperature-humidity setting value determination unit 3*a* in every fixed cycle. This control is based on a room temperature measured value and a room humidity measured value, and is achieved by automatically controlling operational conditions of cooling and heating water flow rate in the air conditioner and of the opening degree of a damper in a pneumatic piping.

Figure 3:
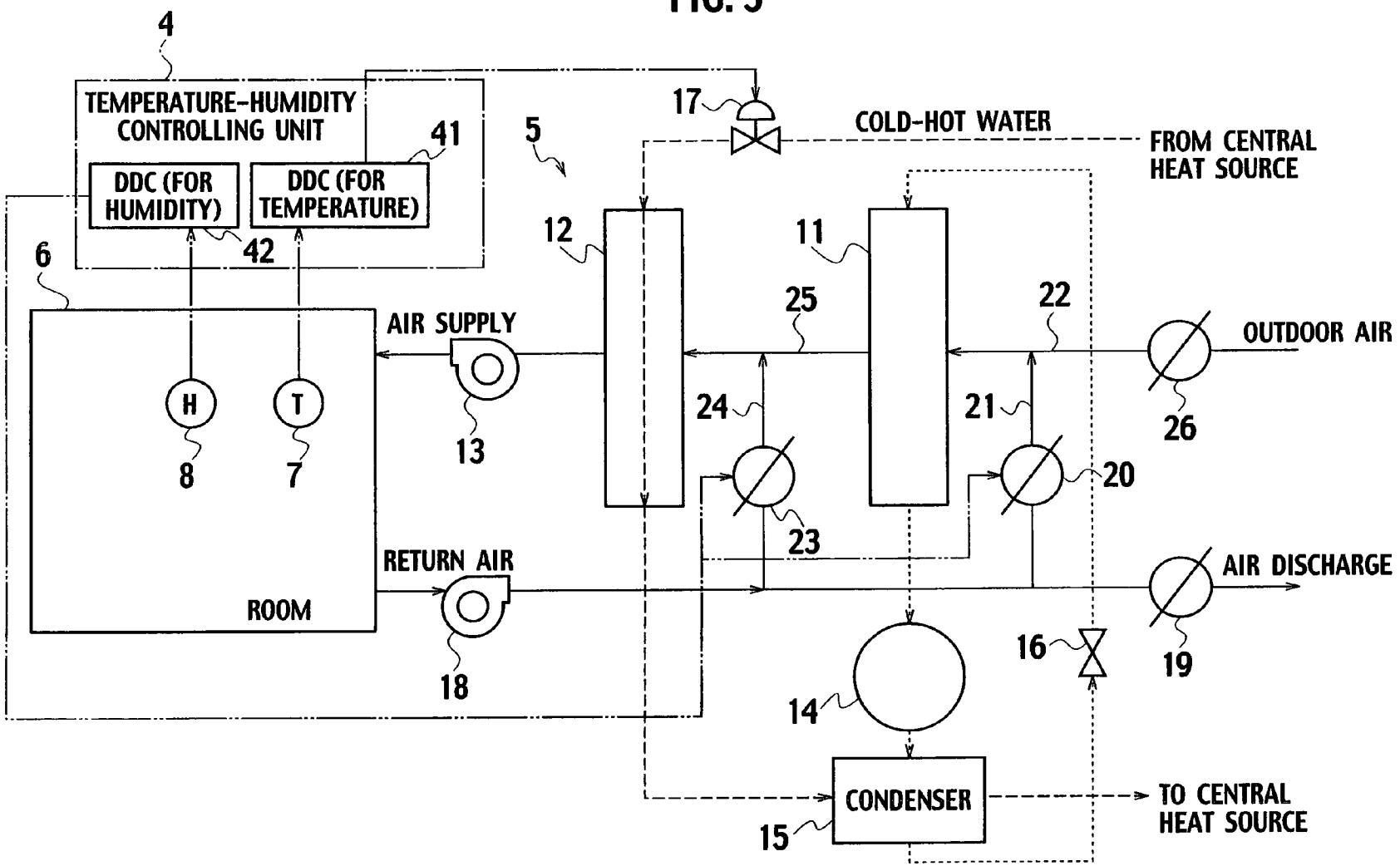
FIG. 3 is a block diagram showing an example of an air conditioning system using a direct expansion coil and a cold-hot water coil, to which the present invention is applied.

FIG. 3 shows a specific system configuration of the air conditioner 5 controlled for adjusting the temperature and humidity by the temperature-humidity control unit 4.

As shown in FIG. 3, the air conditioner 5 includes a direct expansion coil 11 which introduces the outdoor air, and which then cools the air by using a refrigerant or heats the air. The air conditioner 5 further includes a cold-hot water coil 12 that cools or heats, by using cold or hot water, the outdoor air cooled or heated by the direct expansion coil 11, and which thus controls the temperature of the air supplied to the room. The air conditioner 5 supplies the air at the temperature adjudged by the cold-hot water coil 12 to the room 6 by using an air supply fan 13.

The direct expansion coil 11 is connected to a compressor 14 compressing a refrigerant, a condenser 15 condensing the compressed refrigerant, and an expansion valve 16 for expanding the condensed refrigerant, in this order, and these components constitute a refrigerant cycle.

Cold or hot water is supplied to the cold-hot water coil 12 from a central thermal source (not illustrated) through a control valve 17, and thereby the cold-hot water coil 12 supplies the supplied air to the room 6 after cooling or heating the supplied air. The cold water after cooling the cold-hot water coil 12 is supplied as return cold water to the condenser 15, and then is returned to the central thermal source after cooling the condenser 15.

Return air from the room 6 is discharged by a return air fan 18 through a damper 19. Part of the return air is supplied to a piping 22 through a damper 20 and a piping 21, and is mixed, in the piping 22, with the outdoor air introduced through the damper 26. Then the mixed air is supplied to the direct expansion coil 11. In addition, through a damper 23 and a piping 24, part of the return air is supplied to a piping 25 located at the discharging side of the direct expansion coil 11. Then, in the piping 25, the part of the return air is mixed with the outdoor air cooled by the direct expansion coil 11. Thereafter, the mixed air is supplied to the cold-hot water coil 12.

The thermometer 7 and the hygrometer 8 respectively measuring the temperature and humidity in the room 6 are installed in the room 6 to be targeted for air conditioning control. The thermometer 7 and the hygrometer 8 are connected respectively to a DDC 41 for temperature and a DDC 42 for humidity in the temperature-humidity control unit 4. A room temperature signal based on the temperature measured by the thermometer 7 is transmitted to the DDC 41, and then the DDC 41 controls the control valve 17 that supplies cold or hot water to the cold-hot water coil 12. A room humidity signal based on the humidity measured by the hygrometer 8 is transmitted to the DDC 42. Then, the DDC 42 controls the damper 20 that supplies the return air to the direct expansion coil 11, and the damper 23 that supplies the return air to the cold-hot water coil 12.

With the forgoing configuration, the outdoor air introduced from the damper 26 and the piping 22 is cooled in the direct expansion coil 11. Since the evaporation temperature of the refrigerant in an evaporator constituting the direct expansion coil 11 is approximately 5° C., the moisture in the outdoor air can be removed. The room humidity is measured by the hygrometer 8. Then, the moisture removal for controlling the room humidity is performed by adjusting a mixing ratio between the return air, and the outdoor air caused to pass through the evaporator in the direct expansion coil 11. In other words, the DDC 42 controls the mixing ratio by adjusting the opening degrees of the damper 23 and the damper 20, respectively, according to the room humidity measured by the hygrometer 8.

The mixed air after passing through the direct expansion coil 11 is again mixed with the return air which has an amount equivalent to that obtained by subtracting the amount of the return air having passed through the direct expansion coil 11 from the total amount of the return air to be returned to the room 6, and then introduced to the cold-hot water coil 12. As such, the air supercooled in the direct expansion coil 11 is heated by mixing with the return air from the room 6. The temperature in the room 6 is controlled by adjusting the temperature of the supplied air. This control is performed by adjusting the volume of cold/hot water flow in the cold-hot water coil 12 in a way that the DDC 41 automatically controls the opening degree of the control valve 17 according to the signal from the thermometer 7.

According to the foregoing first embodiment, taking the above-described measures makes it possible to control both of room temperature and room humidity, and thereby to achieve an air conditioning control that is finely seasonable and largely effective in energy saving without decreasing comfort of occupants.

Moreover, it is possible to save excessive energy consumption for reheating the air for the room temperature adjustment in the room temperature and humidity control, and thus to achieve energy saving.

Second Embodiment

Figure 4:
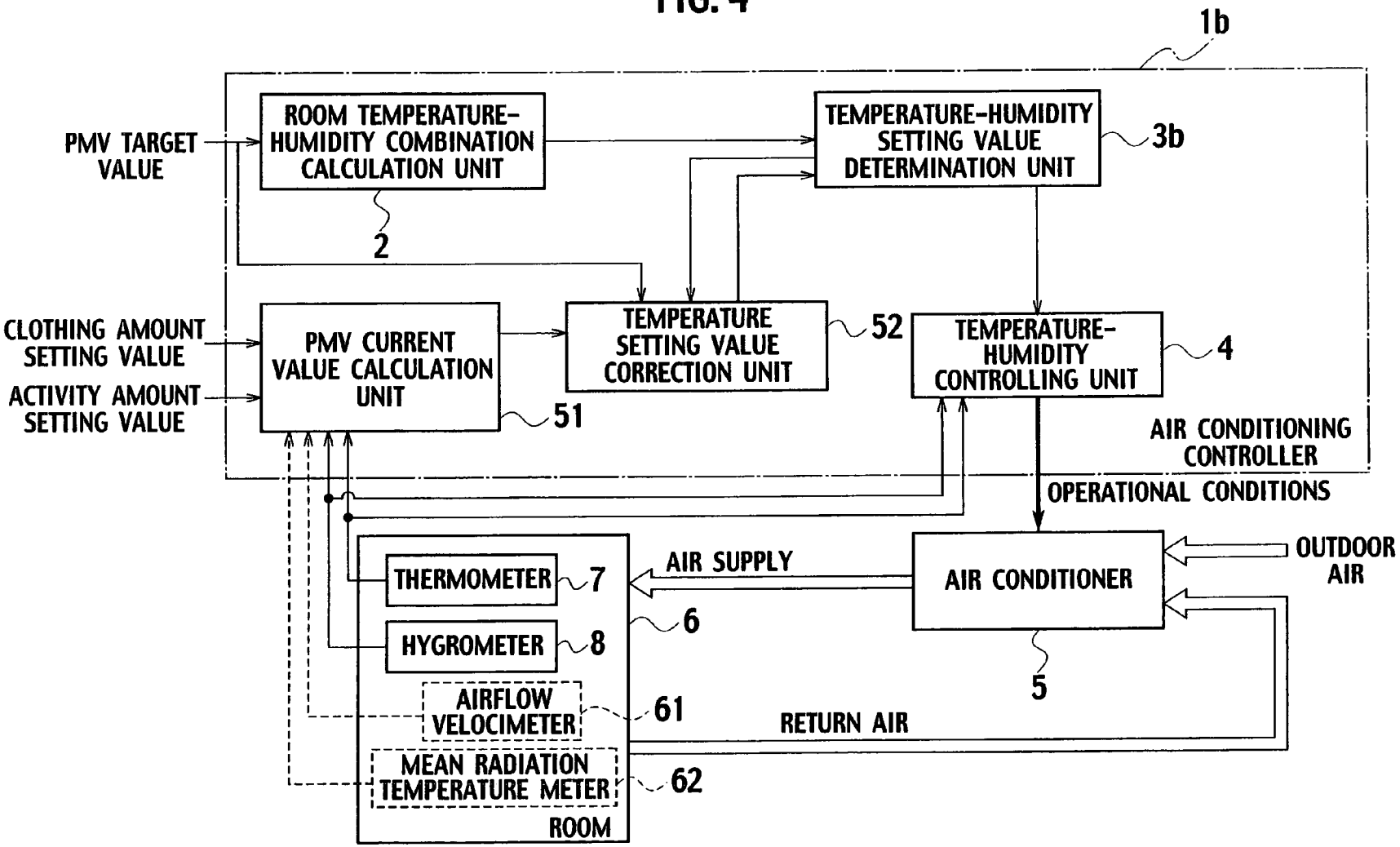
FIG. 4 is a block diagram showing an air conditioning controller according to a second embodiment of the present invention.

FIG. 4 is a block diagram showing an air conditioning controller according to a second embodiment of the present invention. In FIG. 4, the same reference numerals are given to the same components as those in FIG. 1, and the explanation for those components is omitted here.

An air conditioning controller 1*b* shown in FIG. 4 includes a room temperature-humidity combination calculation unit 2 for calculating combinations of the room temperature and humidity corresponding to the PMV target value. The air conditioning controller 1*b* also includes a PMV current value calculation unit 51 for calculating a PMV current value that is a PMV value to be actually targeted at this moment, from a clothing amount setting value and an activity amount setting value. The air conditioning controller 1*b* further includes a temperature setting value correction unit 52. In a case where the calculated PMV current value is different from the PMV target value, the temperature setting value correction unit 52 corrects a temperature setting value so that the PMV current value would be equal to the PMV target value. The air conditioning controller 1*b* also includes a temperature-humidity setting value determination unit 3*b*. Among the combinations of the room temperature and humidity calculated by the room temperature-humidity combination calculation unit 2, the temperature-humidity setting value determination unit 3*b* selects the combination of the room temperature and humidity that can achieve energy saving, in every fixed cycle. Then, the temperature-humidity setting value determination unit 3*b* determines the corrected temperature setting value by using the temperature setting values corrected by the temperature setting value correction unit 52. The air conditioning controller 1*b* further includes a temperature-humidity control unit 4 for separately controlling the room temperature and room humidity so that the room temperature and humidity would measure up respectively to the temperature value and the humidity value determined by the temperature-humidity setting value determination unit 3*b*.

The PMV current value calculation unit 51 calculates the PMV value from the closing amount and activity amount setting values and the measured values of the temperature, humidity and the like. The temperature setting value correction unit 52 figures out the temperature setting value for this cycle by calculating the correction value by using fuzzy inference. The specific method is described in detail, for example, in Japanese Patent No. 3049266 (Japanese Unexamined Patent Application Publication No. Hei 5-126380) and Japanese Patent Application Laid-open Publication No. Hei 10-141736.

Figure 5:
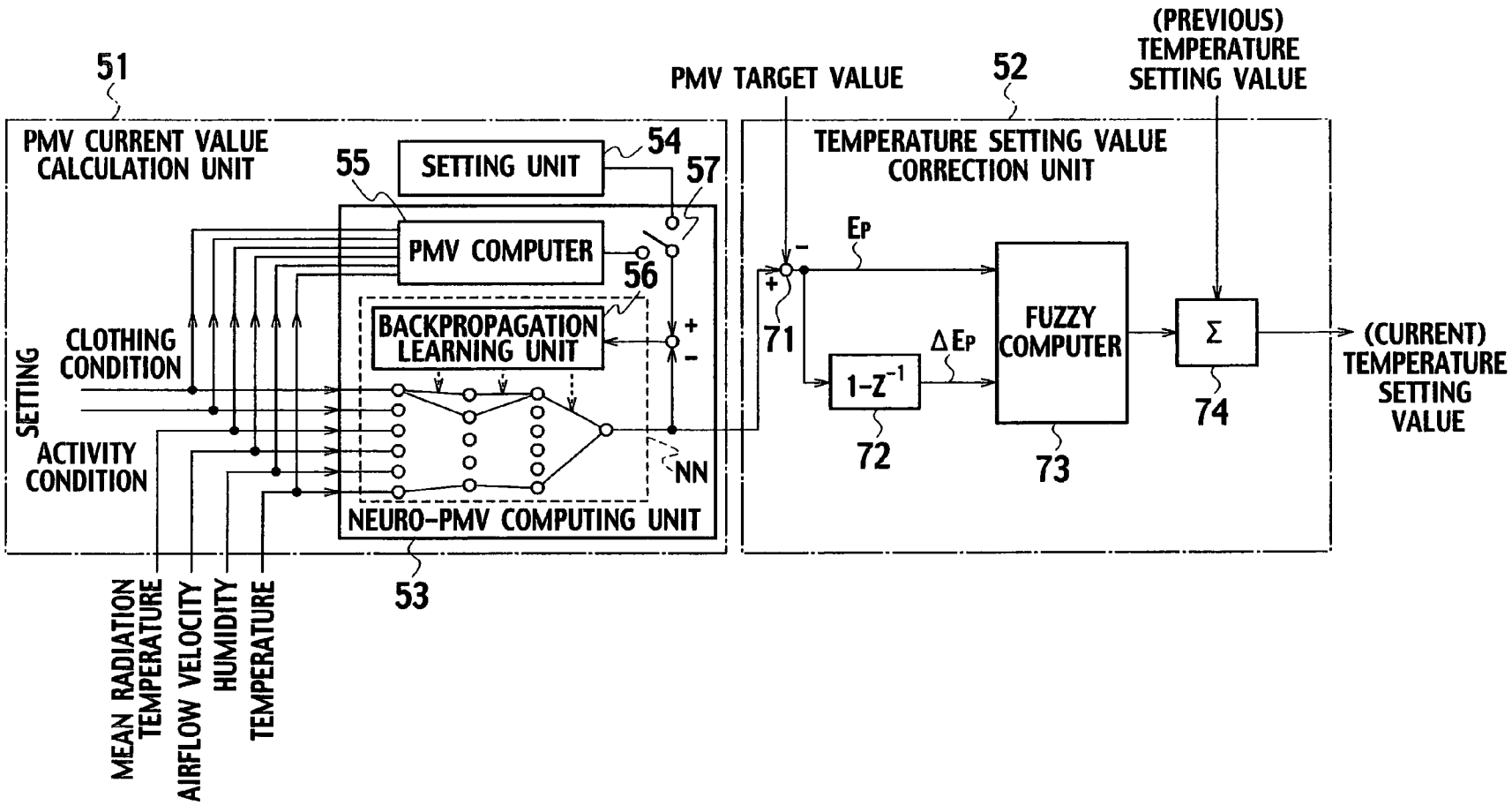
FIG. 5 is a block diagram showing a detailed configuration of a PMV current value calculation unit and a temperature setting value correction unit according to the second embodiment of the present invention.

FIG. 5 shows a specific configuration example of the PMV current value calculation unit 51 and the temperature setting value correction unit 52. This example is disclosed in Japanese Patent No. 3049266.

As shown in FIG. 5, the PMV current value calculation unit 51 includes a neuro-PMV computing unit 53 mainly composed of a neural network NN, and a setting unit 54 for providing data collected from questionnaires to the neural network NN.

The neuro-PMV computing unit 53 includes the neural network NN for figuring out a neuro-PMV value on a learning basis, a PMV computer 55 for figuring out an initial PMV by using a PMV arithmetic expression, a backpropagation learning unit 56 for computing a weight between layers in the neural network NN, and a switch 57 for switching to the setting unit 54 at a time of learning. The neuro-PMV computing unit 53 inputs each of the variables of a clothing condition and an activity condition, as well as the humidity, the temperature, the mean radiation temperature and the airflow velocity in the room 6, and then computes the neuro-PMV value. For this purpose, in addition to a thermometer 7 and a hygrometer 8, an airflow velocimeter 61 and a mean radiation temperature meter 62 are installed in the room 6, as shown in FIG. 4, and the measured values respectively of the temperature, the mean radiation temperature, the airflow velocity and the humidity are provided to the neuro-PMV computing unit 53. The clothing condition and the activity condition are values set from the outside.

The temperature setting value correction unit 52 includes a deviation computer 71, a variation computer 72, a fuzzy computer 73 and an adder 74. The deviation computer 71 figures out a deviation Ep between the calculated neuro-PMV value and the PMV target value. The variation computer 72 computes the variation ΔEp in the deviation Ep. The fuzzy computer 73 inputs the deviation Ep, and the variation ΔEp in the deviation Ep, and then computes the variation in a room temperature setting value by using the fuzzy inference. In addition, the adder 74 figures out the room temperature setting value by summing up the computed variations in the room temperature setting value.

In this case, the variation computer 72 inputs the deviation Ep in the PMV value figured out by the deviation computer 71, computes a difference between the previous and current deviations Ep, and then provides the variation ΔEp in the deviation Ep to the fuzzy computer 73.

A fuzzy control rule table (not illustrated) and a membership function (not illustrated) are set in advance in the fuzzy computer 73. The fuzzy computer 73 figures out the variation (the correction amount) in the temperature setting value by using the fuzzy control rule table and the membership function. The adder 74 figures out the current temperature setting value by adding the variation in the temperature setting value to the previous temperature setting value, and then provides the current temperature setting value to the temperature-humidity setting value determination unit 3*b*. The temperature-humidity setting value determination unit 3*b* determines a corrected temperature setting value by using the temperature setting value figured out by the adder 74.

The following operations of the temperature-humidity setting value determination unit 3*b* and the temperature-humidity control unit 4 are the same as those of the first embodiment shown in FIG. 1.

According to the foregoing second embodiment, taking the above-described measures makes it possible to control both of room temperature and room humidity, and thereby to achieve an air conditioning control that is finely seasonable and largely effective in energy saving without decreasing comfort of occupants.

Other Embodiments

The present invention is not limited to the foregoing first and second embodiments, and can be modified in various ways without departing from the scope of the invention.

For example, in the foregoing embodiments, the lower limit value (for instance, 30%) of the humidity may be set for the case where the temperature-humidity setting value determination unit 3 selects the temperature and humidity from the combinations of the room temperature and humidity (FIG. 2). The reason for this is to avoid an excessively dry condition in a room by taking human health into consideration. Similarly, the higher limit value (for instance, 70%) of the humidity may be set for avoiding an excessively moist condition.

Moreover, although the PMV value used for the thermal comfort index in the foregoing embodiments, any value other than the PMV value, such as "the new effective temperature" or "the standard effective temperature," may be used for the thermal comfort index.

In addition, although the second embodiment has shown the example employing the fuzzy computation as the configuration of the temperature setting value correction unit (see FIG. 5), a PID computation may be employed instead of this.

Furthermore, these embodiments may be performed in any combination as long as they can be. In this case, it is possible to obtain effect brought by the combination.

What is claimed is:

1. An air conditioning controller using thermal sensation of a human as a thermal comfort index, the air conditioning controller comprising:

a room temperature-humidity combination calculation unit configured to calculate combinations of room temperature and room humidity corresponding to a target value of the thermal comfort index;

a temperature-humidity setting value determination unit configured to:

select a combination of the room temperature and the room humidity that achieves energy saving, in every fixed cycle, from among the calculated combinations, the selected combination minimizing a difference between a room air enthalpy calculated from the room temperature and the room humidity, and an outdoor air enthalpy calculated from an outdoor temperature and an outdoor humidity; and determine a temperature setting value and a humidity setting value; and a temperature-humidity control unit configured to separately control the room temperature and the room humidity so that the room temperature and the room humidity correspond respectively to the determined temperature setting value and the determined humidity setting value.

2. The air conditioning controller according to claim 1, wherein a Predicted Mean Vote (PMV) is used as the thermal comfort index.

3. The air conditioning controller according to claim 1, wherein the temperature-humidity setting value determination unit is further configured to determine the humidity setting value within an arbitrary limited range.

* * * * *